US008057241B2

(12) United States Patent
Tamura

(10) Patent No.: US 8,057,241 B2
(45) Date of Patent: Nov. 15, 2011

(54) CONNECTOR AND INTERPOSER USING THE SAME

(75) Inventor: Akira Tamura, Kawasaki (JP)

(73) Assignee: Fujitsu Limited, Kawasaki-shi (JP)

( * ) Notice: Subject to any disclaimer, the term of this patent is extended or adjusted under 35 U.S.C. 154(b) by 0 days.

(21) Appl. No.: 12/859,847

(22) Filed: Aug. 20, 2010

(65) Prior Publication Data

US 2011/0059631 A1 Mar. 10, 2011

(30) Foreign Application Priority Data

Sep. 7, 2009 (JP) ..... 2009-206273

(51) Int. Cl.
*H01R 12/00* (2006.01)

(52) U.S. Cl. ..... 439/66

(58) Field of Classification Search ..... 439/66, 439/862, 495, 74, 872, 83
See application file for complete search history.

(56) References Cited

U.S. PATENT DOCUMENTS

| | | | | |
|---|---|---|---|---|
| 4,969,826 | A | 11/1990 | Grabbe | |
| 5,167,512 | A * | 12/1992 | Walkup | 439/66 |
| 5,437,556 | A * | 8/1995 | Bargain et al. | 439/66 |
| 6,132,220 | A * | 10/2000 | McHugh et al. | 439/66 |
| 6,164,978 | A * | 12/2000 | McHugh et al. | 439/66 |
| 6,257,899 | B1 * | 7/2001 | Walkup | 439/66 |
| 6,264,476 | B1 | 7/2001 | Li et al. | |
| 6,273,731 | B1 * | 8/2001 | Bishop et al. | 439/66 |
| 6,731,516 | B1 * | 5/2004 | Ma | 361/802 |
| 7,052,284 | B2 * | 5/2006 | Liao et al. | 439/66 |
| 7,121,839 | B2 * | 10/2006 | Rathburn | 439/66 |
| 7,160,115 | B2 * | 1/2007 | Huang et al. | 439/66 |
| 7,214,069 | B2 * | 5/2007 | Rathburn | 439/66 |
| 7,261,567 | B2 * | 8/2007 | Mendenhall et al. | 439/66 |
| 7,555,834 | B2 * | 7/2009 | Perugini | 29/842 |
| 7,614,883 | B2 * | 11/2009 | Mendenhall et al. | 439/66 |
| 7,625,216 | B2 * | 12/2009 | Mendenhall et al. | 439/66 |
| 7,878,817 | B2 * | 2/2011 | Lin et al. | 439/66 |
| 7,900,347 | B2 * | 3/2011 | Rathburn | 29/831 |

FOREIGN PATENT DOCUMENTS

| | | |
|---|---|---|
| JP | 2001-176580 | 6/2001 |

* cited by examiner

*Primary Examiner* — Jean Duverne
(74) *Attorney, Agent, or Firm* — Squire, Sanders & Dempsey (US) LLP

(57) ABSTRACT

A connector includes a movable conductive element and an elastic body. The connector electrically conducts between opposed external electrodes disposed vertically. The movable conductive element has a pair of rigid contact. And the elastic body deforms elastically to receive the load caused by the movement of the movable conductive element.

19 Claims, 9 Drawing Sheets

CONNECTOR AND INTERPOSER USING THE SAME

CROSS-REFERENCE TO RELATED APPLICATIONS

This application is based upon and claims the benefit of priority of the prior Japanese Patent Application No. 2009-206273, filed on Sep. 7, 2009, the entire contents of which are incorporated herein by reference.

FIELD

The embodiments discussed herein are related to a technology for a connector and an interposer using the connector.

BACKGROUND

Conventionally, when a semiconductor integrated circuit (IC) package is mounted on a circuit board, lead wires projecting from the side surface of the IC package are inserted into through-holes with lands of a circuit pattern on the circuit board. And the lead wires are electrically connected to the lands with solder. On the other hand, in recent years, the number of input-output terminals of the IC package is increasing with improvement of the integration density of the IC. Furthermore since operating frequency of the IC rises, there is a demand for improving the high-frequency characteristic of the circuit board. Therefore demands for high density mounting on the circuit board and short distance connection in the circuit board and narrow pitch mounting on the circuit board are increasing.

For example, techniques for providing the input-output terminals in a reticular pattern formed on the back side of the IC package such as BGA (Ball Grid Array) and LGA (Land Grid Array) and for mounting the IC package on the surface of the circuit board so as to dispose the input-output terminals efficiently under these demands are proposed. The surface mount technology that uses an interposer as an interconnecting board between the IC package and the circuit board is proposed. The interposer includes an insulation material sheet and a conductor (for example, connector). The insulation material sheet has through-holes corresponding to input-output terminals formed in a grid-array pattern on the IC package. And the conductors are inserted into these through-holes to conduct electrically in vertical direction of the insulation material sheet. Terminal patterns arranged in a grid-array pattern that is similar to that of the IC package are formed on the circuit board. It is illustrated using FIG. 1 to mount the IC package on the circuit board using the interposer.

FIGS. 1A to 1C illustrate a conventional interposer. FIG. 1A illustrates that an interposer 2 is disposed between a circuit board 3 and an IC package 1. Moreover, FIG. 1B illustrates a side view of FIG. 1A, and especially a cross-sectional view of the interposer 2. Input-output terminals 4 (electrodes) are provided in a grid-array pattern formed on the back side of the IC package 1. And for mounting the IC package 1 on the circuit board 3, each of terminal patterns 6 (electrodes) is formed at position corresponding to each of the input-output terminals 4.

The interposer 2 is disposed between the IC package 1 and the circuit board 3, and connects the input-output terminals 4 on the back side of the IC package 1 to the terminal patterns 6 on the circuit board 3. The interposer 2 has a plurality of through-holes 9, which are formed into the insulation material sheet (hereinafter called an interposer substrate) 8. Each of the through-holes 9 corresponds to each of the input-output terminals 4 in the grid-array pattern formed on the IC package 1. A connector 5 is inserted into the through-hole 9. Each of the connectors 5 is the same length, and the connector 5 is made of the conductive material that electrically conducts between the front side and the back side of the interposer substrate 8.

The interposer 2 is generally disposed inside a socket 7 illustrated in FIG. 1C, and the socket 7 is mounted on the circuit board 3 by soldering. When the socket 7 is used, the IC package 1 is easy to mount and demount on the circuit board 3.

In the interposer 2 as mentioned above, the structure of the connector 5 that is made of the conductor which conducts electricity between the front side and the back side of the interposer substrate 8 is important. The connector 5 is placed and compressed between the input-output terminal 4 on the back side of the IC package 1 and the terminal patterns 6 on the circuit board 3. Therefore the connector 5 has elasticity to conduct electricity between the IC package 1 and the circuit board 3 while being compressed under pressure from both the IC package 1 and the circuit board 3.

As a structure to provide elasticity to the connector 5, Japanese Laid-open Patent Publication No. 2001-176580 (hereinafter called "patent document 1") discloses the connector that includes a flexible conductive element wound around the compressible insulating core and a compressible elastic outer shell the surrounding the conducting element. The patent document 1 also discloses that the outer shell is an elastic body such as rubber, and that the outer shell surrounding the core is surrounded by an insulating layer made of a conductive wire mesh or a continuous metallic layer.

However, as a structure to provide elasticity to the connector 5, the patent document 1 discloses the structure that builds a zigzag wire, a pleat wire or a coiled wire into the main body of the elastic body, and discloses the structure that builds a metallic spring into the main body of the elastic body. However, there is a problem that the structure disclosed in the patent document 1 physically has the limit of downsizing. Moreover, there are problems that the structure disclosed in the patent document 1 is complex and causes high cost.

FIGS. 2A to 2D illustrate a conventional connector. As the solution of the problems described above, the connector 50 that has an elastic connection body 52 illustrated in FIG. 2A is proposed. The connector 50 has the elastic connection body 52 that includes a U-shape conductive spring 53, and the connector 50 is fitted in a through-hole 9 of the interposer substrate 8 as illustrated in FIG. 2B.

Both ends of the spring 53 of the elastic connection body 52 are contact parts 54 and 55. As shown in FIG. 2C, when an interposer 80 is disposed at a predetermined position on the circuit board 3 and the IC package 1 is mounted on the interposer, the contact part 54 contacts the input-output terminal 4 of the IC package 1 and the contact part 55 contacts the terminal pattern 6 of the circuit board 3. Consequently, the pressure received from the IC package 1 and the circuit board 3 is absorbed as the spring 53 is bent.

FIG. 2D illustrates an interposer 70 including a connector 60 with a similar structure to the connector 50 described in FIGS. 2A to 2C, and it is described in U.S. Pat. No. 4,969,826 (hereinafter called "patent document 2"). The interposer 70 includes an interposer substrate 68 having through-holes 69 and the connector 60 provided in the through-holes 69. A contact 65 is provided in a housing 64 of the connector 60. The contact 65 includes two contact parts 61 and 62 and a spring 63 that connects between the contact part 61 and the contact part 62. The contact parts 61 and 62 protrude from the top surface and the bottom surface of the interposer substrate 68 respectively. The contact part 61 contacts with the input-output terminal 4 of the IC package 1 and the contact part 62 contacts with the terminal pattern 6 of the circuit board 3 as well as the structure of the connector 50 described in FIGS. 2A to 2C.

However, as illustrated FIGS. 2A to 2C, the interposer 2 in which the U-shape conductive spring 53 is built has some problems. There are problems that a downsizing of the interposer 2 is limited to secure a prescribed deformation amount of a metallic spring, a design of the interposer 2 is difficult, and an electric resistance of the interposer 2 is large because a current pathway is long. FIG. 7A illustrates relation between deformation amount of the connector and contact pressure of the connector. In FIG. 7A, P in y-axis indicates contact pressure of the connector, A in y-axis indicates a range of the contact pressure, D in x-axis indicates deformation amount of the connector and B indicates a range of the deformation amount. As disclosed in the patent document 2, there is a problem that the range of the contact pressure corresponding to the range of the deformation amount in the contact part is large, that is, the variation of the contact pressure is large, as illustrated in FIG. 7A.

SUMMARY

According to an aspect of the invention, a connector includes a movable conductive element and an elastic body. The connector electrically conducts between opposed external electrodes disposed vertically. The movable conductive element has a pair of rigid contact. And the elastic body deforms elastically to receive the load caused by the movement of the movable conductive element.

The object and advantages of the invention will be realized and attained by means of the elements and combinations particularly pointed out in the claims. It is to be understood that both the foregoing general description and the following detailed description are exemplary and explanatory and are not restrictive of the invention, as claimed.

DESCRIPTION OF EMBODIMENTS

Hereafter, a connector and an interposer including the plurality of the connectors according to embodiments are described in detail with reference to the accompanying drawings.

Figure 3A:
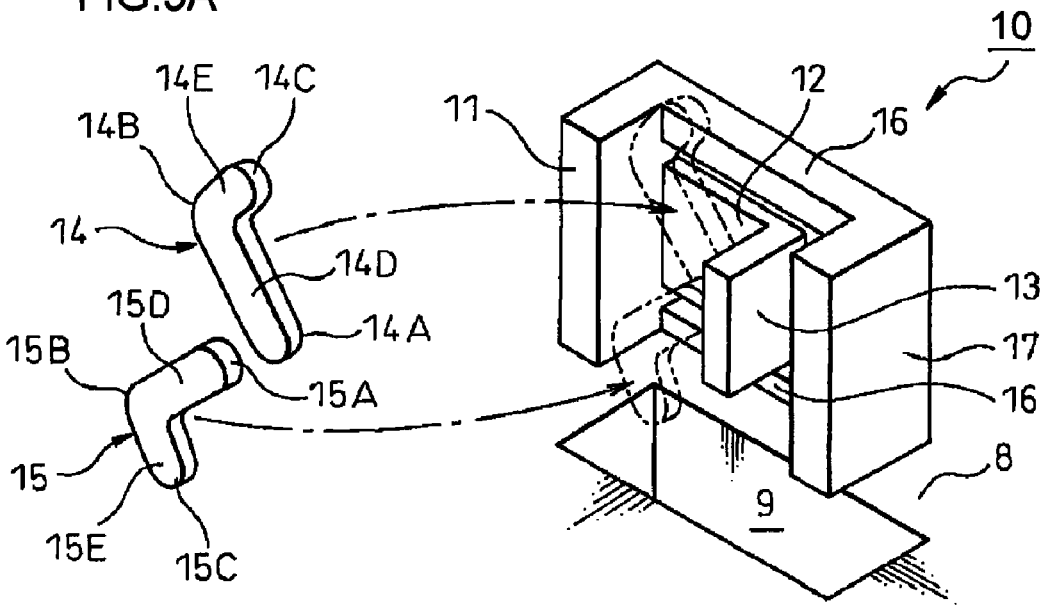
FIGS. 3A to 3E illustrate a connector according to a first embodiment.

FIGS. 3A to 3E illustrate a connector according to a first embodiment. As a housing unit, the connector 10 includes a base unit 11, two frames 16 that extend from both ends of the base unit 11 and a positioning unit 17 that is provided with both ends of the two frames 16 as illustrated in FIG. 3A. In this embodiment, the two frames 16 are perpendicular to the base unit 11, and the positioning unit 17 is perpendicular to the two frames 16. Therefore, the positioning unit 17 is parallel to the base unit 11 in this embodiment.

A plate-like spring body 12 is extended from the base unit 11 inside the space enclosed by the base unit 11, the two frames 16 and the positioning unit 17. And, a holding unit 13 is disposed at the end of the spring body 12. An enough space remains between the holding unit 13 and the positioning unit 17. The holding unit 13 is made of conductor. The base unit 11, the spring body 12, and the holding unit 13 serve as an elastic body that receives the load caused by the movement of contacts 14 and 15 described below. The contacts 14 and 15 are an example of a movable conductive element described in claims.

In addition, nearly L-shaped two contacts 14 and 15 are fitted between the base unit 11 and the holding unit 13. The contacts 14 and 15 are made of the conductor. There are a long axis 14D and a short axis 14E in the contact 14. The end of the long axis 14D is an action part 14A. There is a sliding part 14B in the intersection part between the long axis 14D and the short axis 14E. The end of the short axis 14E is a contact part 14C. Similarly, there are a long axis 15D and a short axis 15E in a contact 15. The end of the long axis 15D is an action part 15A. There is a sliding part 15B in the intersection part between the long axis 15D and the short axis 15E. The end of the short axis 15E is a contact part 15C. The action parts 14A and 15A are held by the holding unit 13. The sliding parts 14B and 15B come into contact with the inner surface of the base unit 11. The contact 14 and 15 are fitted between the base unit 11 and the holding unit 13 so that the contact parts 14C and 15C protrude outside the frame 16.

Figure 3B:
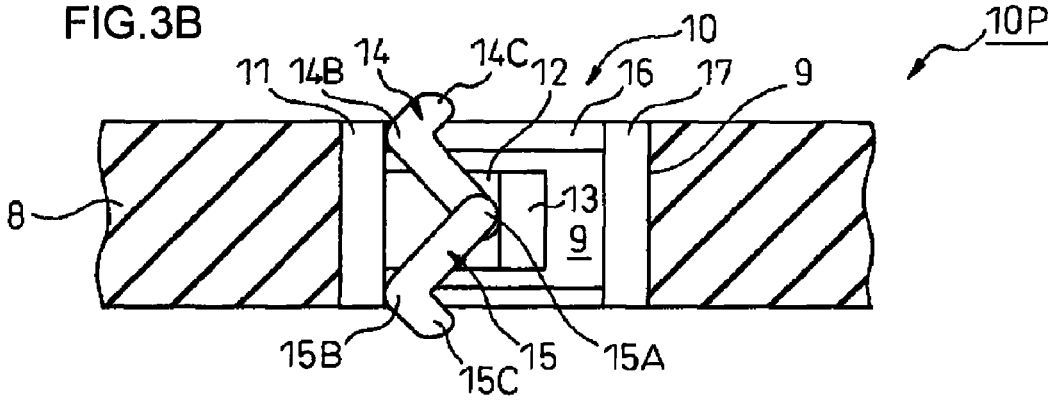
Figure 3C:
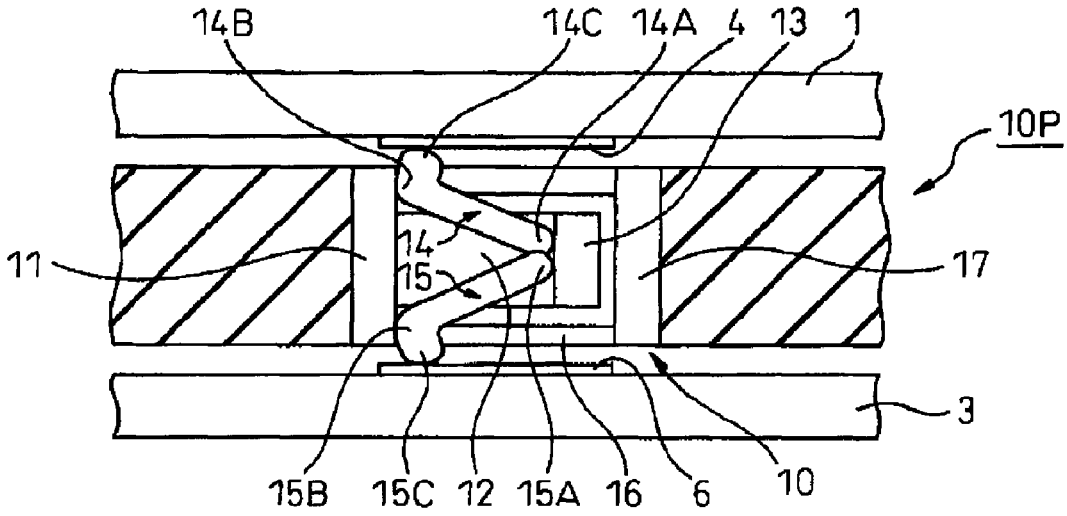
Figure 3D:
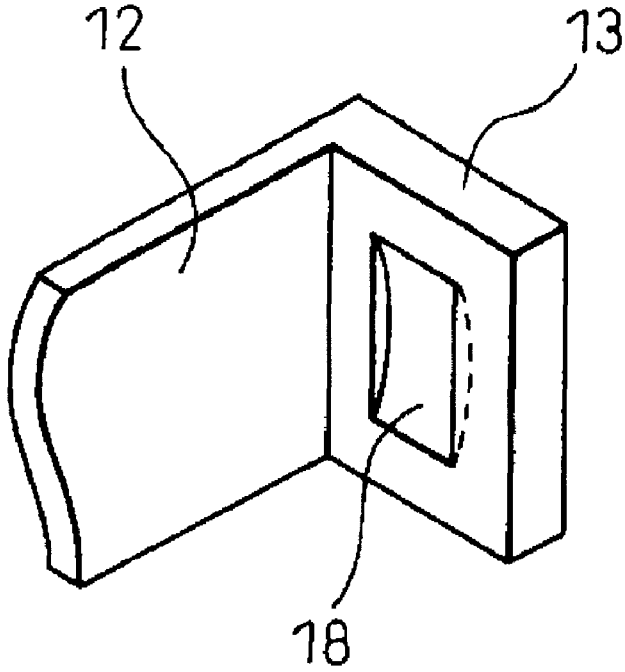
Figure 3E:
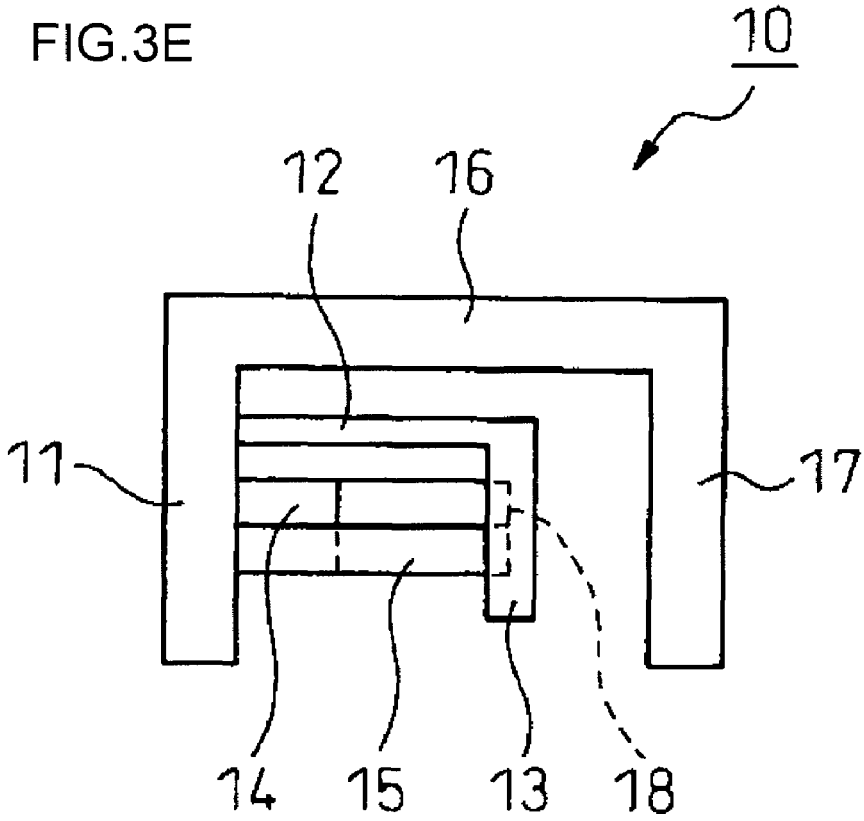

As illustrated in FIG. 3D, a recess 18 may be provided to receive the action part 14A of the contact 14 and the action part 15A of the contact 15 on the inner surface of the holding unit 13, so that the contacts 14 and 15 fitted between the base unit 11 and the holding unit 13 are prevented from being released. FIG. 3E illustrates that the contacts 14 and 15 are fitted between the base unit 11 and the holding unit 13 with a recess 18.

Figure 1A:
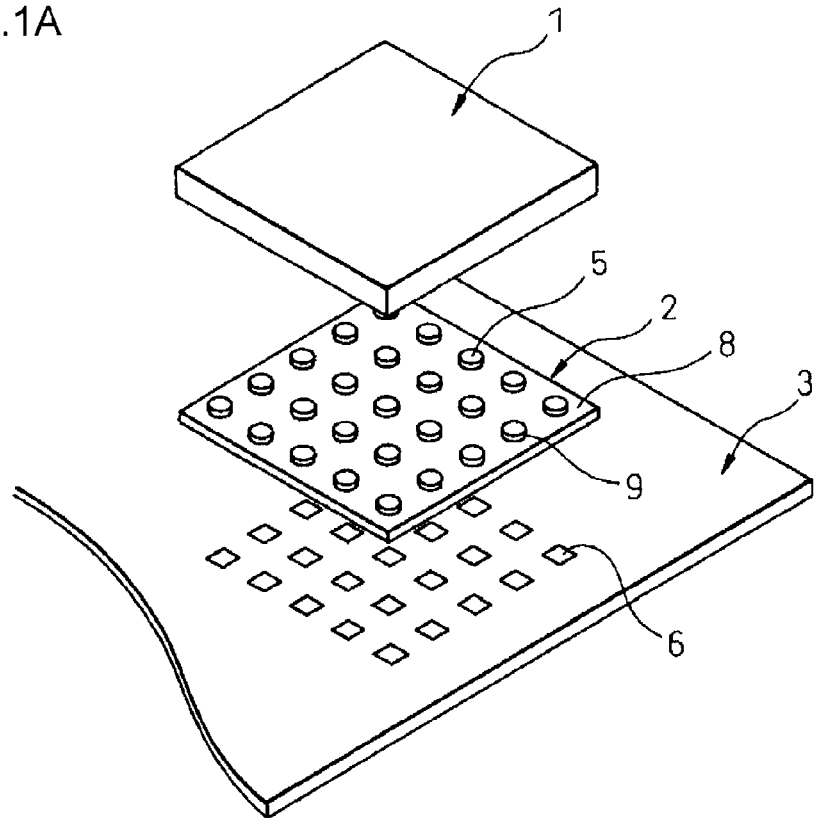
FIGS. 1A to 1C illustrate a conventional interposer.
Figure 1B:
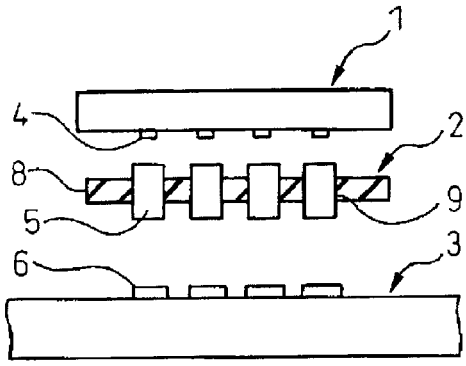
Figure 1C:
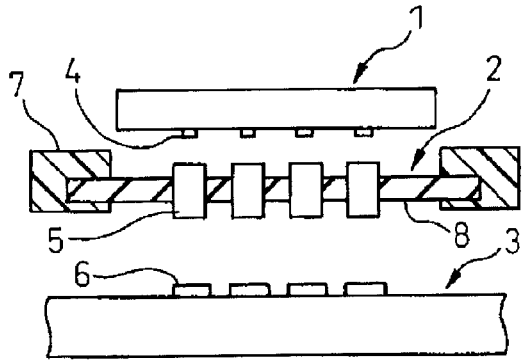
Figure 2A:
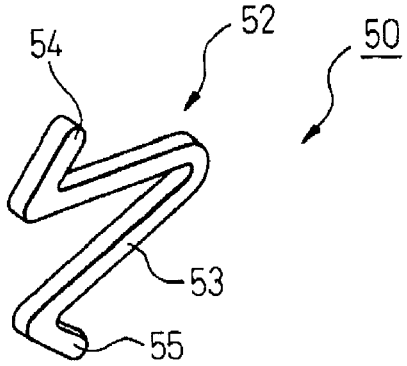
FIGS. 2A to 2D illustrate a conventional connector.
Figure 2B:
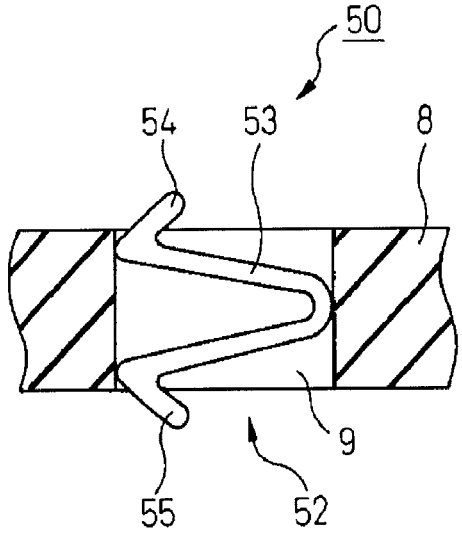
Figure 2C:
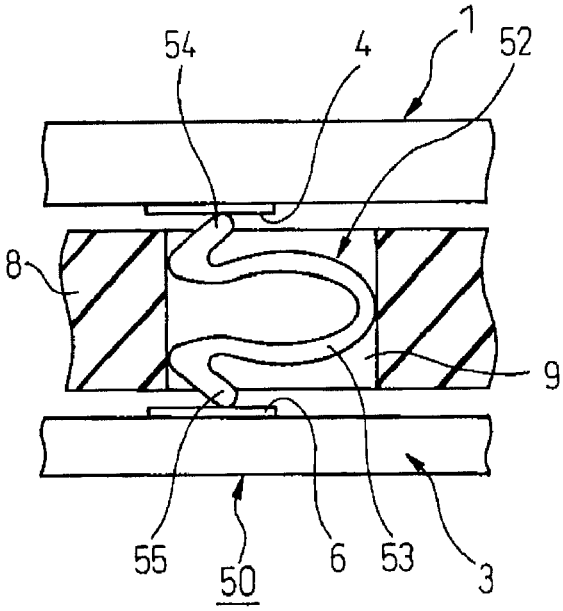
Figure 2D:
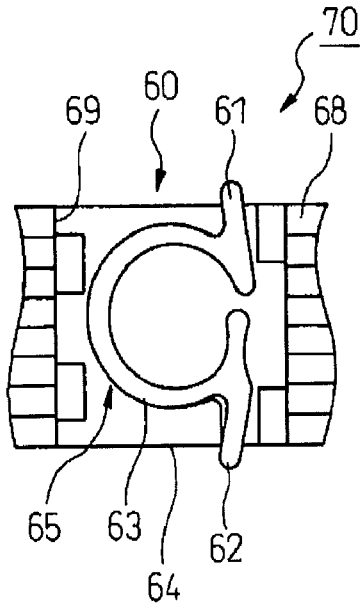

The connector 10 that the contacts 14 and 15 are fitted between the base unit 11 and the holding unit 13 is inserted in a rectangular through-hole 9 formed in the interposer substrate 8. The interposer substrate 8 is made of a dielectric material. Distance between the outer surface of the base unit 11 and the outer surface of the positioning unit 17 is equal to the length of the long side of the rectangular through-hole 9. Each of width of the base unit 11 and width of the positioning unit 17 is equal to the short side of the rectangular through-hole 9. The ratio between the length of the long side of the rectangular through-hole 9 and the length of the short side of the rectangular through-hole 9 is about 1.4:1. FIG. 3B illustrates that the connector 10 is inserted in the rectangular through-hole 9 that is formed in the interposer substrate 8. That is, the interposer 10P of the first embodiment is that the connector 10 of the first embodiment is inserted in the interposer substrate 8 instead of the connector 5 illustrated in FIG. 1A.

FIG. 3C illustrates that the IC package 1 is mounted on the front side of the interposer 10P illustrated in FIG. 3B and the circuit board 3 is mounted on the back side of the interposer 10P. When the contact part 14C of the contact 14 of the interposer 10P is pressed by an input-output terminal 4 of the IC package 1 and the contact part 15C of the contact 15 of the interposer 10P is pressed by a terminal pattern 6 of the circuit board 3, the contact parts 14C and 15C are points of force, the sliding part 14B and 15B are fulcrums, and the action parts 14A and 15A are points of action. That is, when suppress strength is added to the contact parts 14C and 15C (the points of force), the sliding parts 14B and 15B (the fulcrums) slide on the inner surface of the base unit 11 and the action parts 14A and 15A (the points of the action) pushes the holding unit 13. As a result, the spring body 12 is deformed, and the holding unit 13 moves by deforming The contacts 14 and 15 conduct by contact with each other or conduct through the holding unit 13 which is made of conductor. Therefore, the length of path for an electric signal between the contact parts 14C and 15C is equal to the length that the length of the contact 14 is added to the length of the contact 15. The length of the path for the electric signal is shorter than the length of the path for the electric signal in the elastic connection body 52 described in FIG. 2. As the contacts 14 and 15 are made of rigid body, each length of the contacts 14 and 15 is not changed by movement of the contacts 14 and 15. That is, the length of the path for the electric signal between the contact parts 14C and 15C before the IC package 1 is mounted as illustrated in FIG. 3B is the same as the length of the path for the electric signal between the contact parts 14C and 15C after the IC package is mounted as illustrated in FIG. 3C.

Figure 4A:
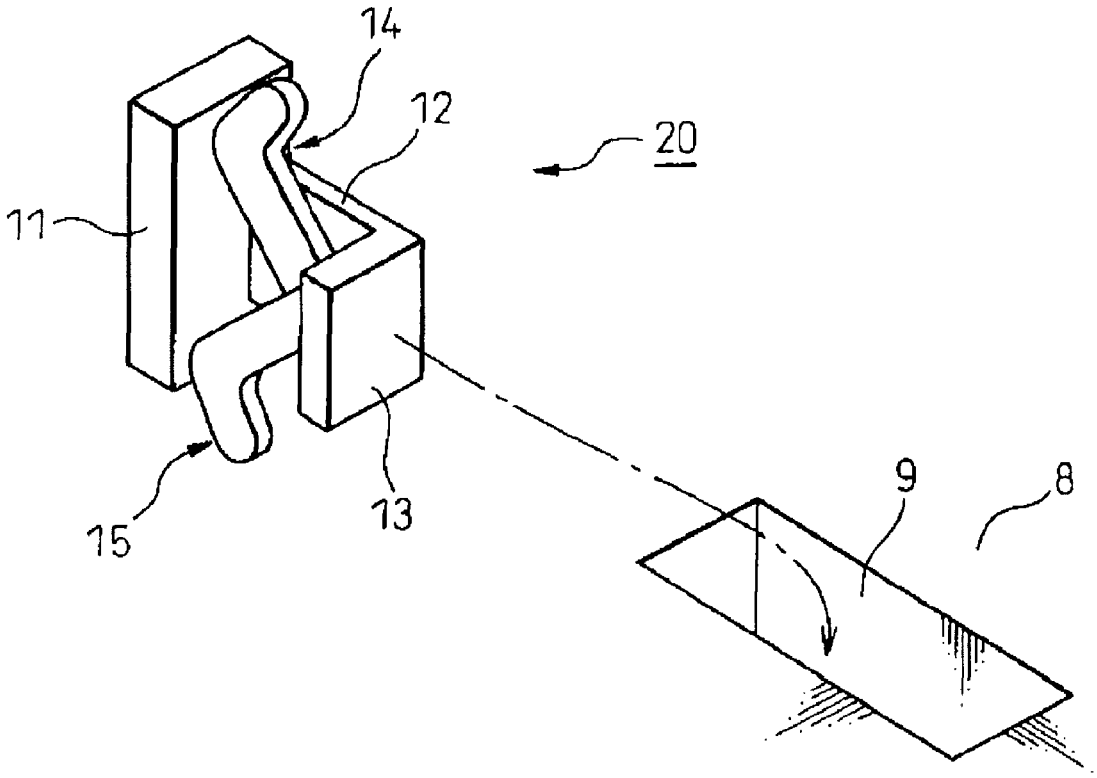
FIGS. 4A to 4B illustrate a connector according to a second embodiment.
Figure 4B:
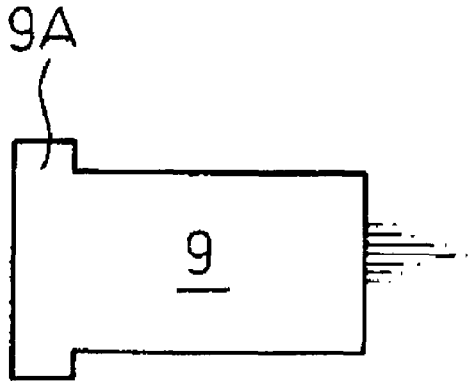

Next, FIGS. 4A to 4B illustrate a connector according to a second embodiment. The points that the connector 20 of the second embodiment is different from the connector 10 of the first embodiment are that the connector 20 has without the frame 16 and without the positioning unit 17 as illustrated in FIG. 4A. As the other components are the same as those of the connector 10, and description thereof is omitted. When the connector 20 in the second embodiment is inserted into the rectangular through-hole 9 that is formed in the interposer substrate 8, the outer surface of the base unit 11 is bonded on the inner surface of the rectangular through-hole 9. Moreover, as illustrated in FIG. 4B, when grooves 9A in which the base unit 11 is fitted are formed in the rectangular through-hole 9 of the interposer substrate 8, the connector 20 may be fitted in the interposer substrate 8 without bonding.

Figure 5A:
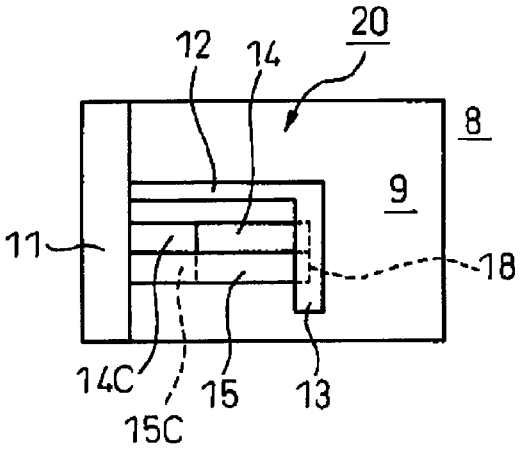
FIGS. 5A to 5F illustrate a connector according to a variation example of the second embodiment.
Figure 5B:
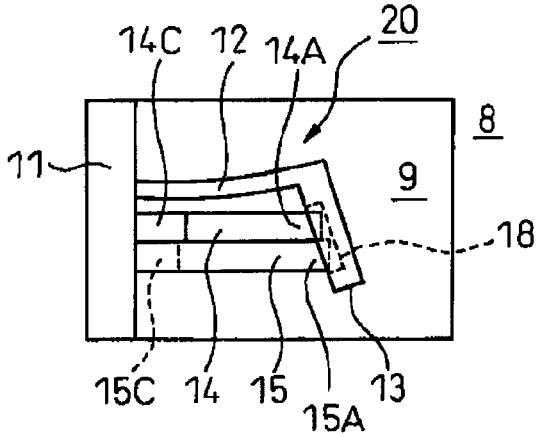

FIGS. 5A to 5F illustrate a connector according to a variation example of the second embodiment. FIG. 5A illustrates that the connector 20 of the second embodiment illustrated in FIG. 4C is inserted into the through-hole 9 formed in the interposer substrate 8. Moreover, FIG. 5B illustrates that the contact part 14C of the contact 14 of the connector 20 and the contact part 15C of the contact 15 of the connector 20 are pushed by two electrodes. When the action parts 14A and 15A push the holding unit 13 by movement of the contacts 14 and 15, the spring body 12 is bent and thereby the holding unit 13 moves. As the contacts 14 and 15 are rigid bodies, the contacts 14 and 15 are not deformed.

Figure 5C:
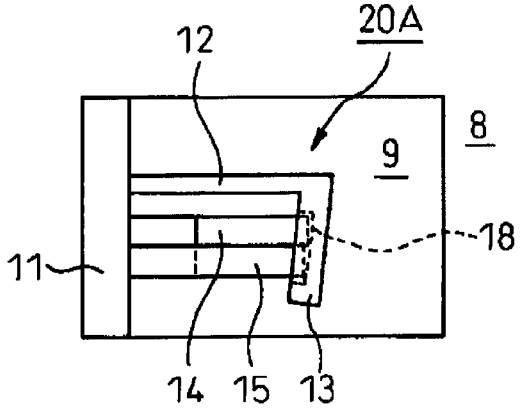
Figure 5D:
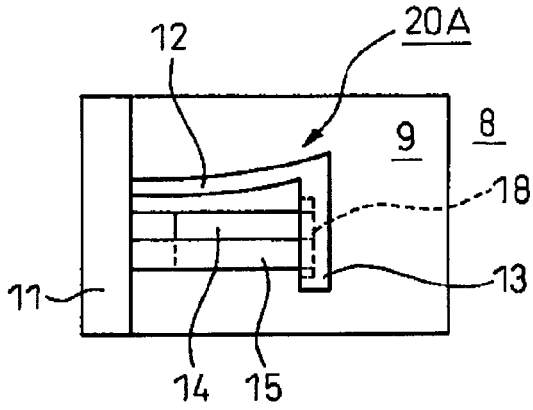

FIG. 5C illustrates an interposer using a connector 20A of the first variation of the connector 20 illustrated in FIG. 5A. In this first variation, the holding unit 13 is angularly disposed to the spring body 12. The other components are the same as those of the connector 20. FIG. 5D illustrates that the connector 20A are compressed by the two electrodes. And when the IC package 1 is mounted on the circuit board 3, as the holding unit 13 becomes parallel to the base unit 11, the contacts 14 and 15 are stably held to the holding unit 13.

Figure 5E:
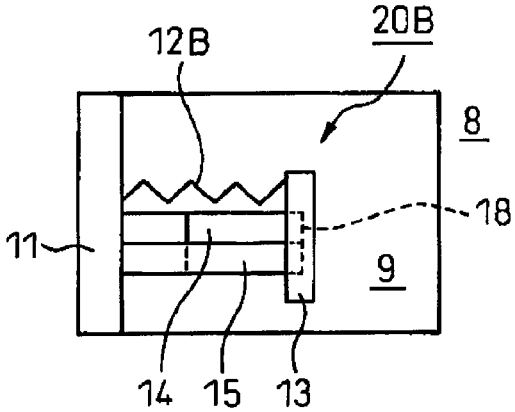
Figure 5F:
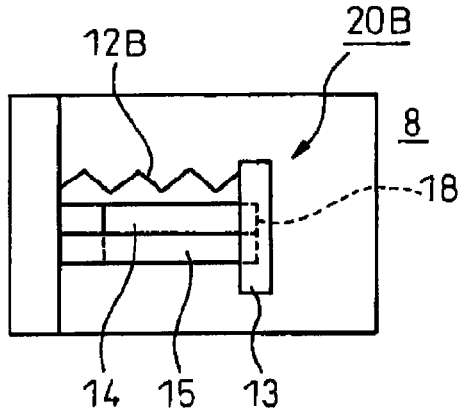

FIG. 5E illustrates a connector 20B of the second variation of the connector 20 illustrated in FIG. 5A. In this second variation, the spring body 12 is made of an accordion spring 12B. The other components are the same as those of the connector 20. In the second variation, FIG. 5F illustrates that the connector 20B is compressed by the two electrodes, when the IC package 1 mounted on the circuit board 3. As a result, the holding unit 13 becomes parallel to the base unit 11 as the accordion spring 12B expands. Therefore, in the second variation, the contacts 14 and 15 are more firmly held by the holding unit 13. The shape of the spring body 12 is not limited to the accordion type.

Figure 6A:
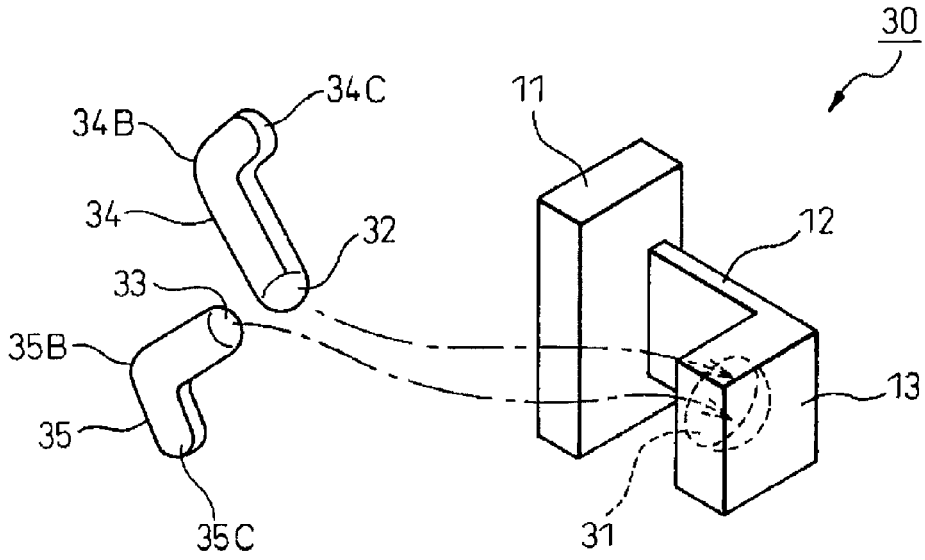
FIGS. 6A to 6C illustrate a connector according to a third embodiment.
Figure 6B:
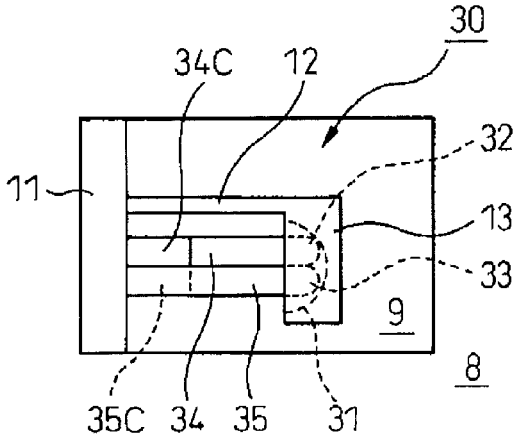
Figure 6C:
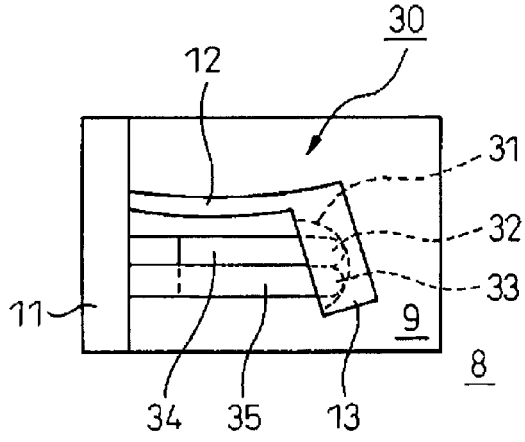

Next, FIGS. 6A to 6C illustrate a connector according to a third embodiment. The points that a connector 30 of the third embodiment are different from the connector 20 of the second embodiment are a structure of the holding unit 13 and the shape of the action part 32 of the contact 14 and the shape of the action part 33 of the contact 15 engaging with the holding unit 13 as illustrated in FIG. 6A. The other components are the same as those of the connector 20 of the second embodiment, and description thereof is omitted. In the connector 30 of the third embodiment, a hemisphere recess 31 is formed into the inner surface of the holding unit 13. And the action part 32 of the contact 34 and the action part 33 of the contact 35 are spherically formed. Reference marks 34B and 35B represent sliding parts. Reference marks 34C and 35 C represent contact parts. The contacts 34 and 35 are fitted between the hemisphere recess 31 of the base unit 11 and the holding unit 13 as well as the connector 10 of the first embodiment and the connector 20 of the second embodiment.

FIG. 6B illustrates a plan view that the connector 30 illustrated in FIG. 6A is assembled and is fitted into the through-hole 9 of the interposer substrate 8. The action part 32 of the contact 34 and the action part 33 of the contact 35 are fitted in the hemisphere recess 31 that is formed in the inner surface of the holding unit 13. When the terminal pattern 6 (electrode) of the circuit board 3 is connected with the top of the connector 30 (the contact part 34C) and the input-output terminal 4 (electrode) of the IC package 1 is connected with the bottom (the contact part 35C) of the connector 30, the contact part 34C of the contact 34 of the connector 30 and the contact part 35C of the contact 35 of the connector 30 are pushed by the two electrodes and move as illustrated in FIG. 6C.

FIG. 6C illustrates that the spring body 12 curves and the holding unit 13 moves since the action parts 32 and 33 push the holding unit 13 by the movement of the contacts 34 and 35. However, in the third embodiment, as the holding unit 13 has the hemisphere recess 31, the action part 32 of the contact 34 and the action part 33 of the contact 35 are more firmly held and held in the hemisphere recess 31. As a result, the action part 32 of the contact 34 and the action part 33 of the contact 35 are not easily released from the hemisphere recess 31.

A recess may be provided to receive the sliding part 14B of the contact 14, the sliding part 15B of the contact 15, the sliding part 34B of the contact 34 and the sliding part 35B of the contact 35 on the inner surface of the base unit 11, so that the sliding part 14B of the contact 14, the sliding part 15B of the contact 15, the sliding part 34B of the contact 34 and the sliding part 35B of the contact 35 do not release from the base unit 11 when they slide on the base unit 11.

Figure 7A:
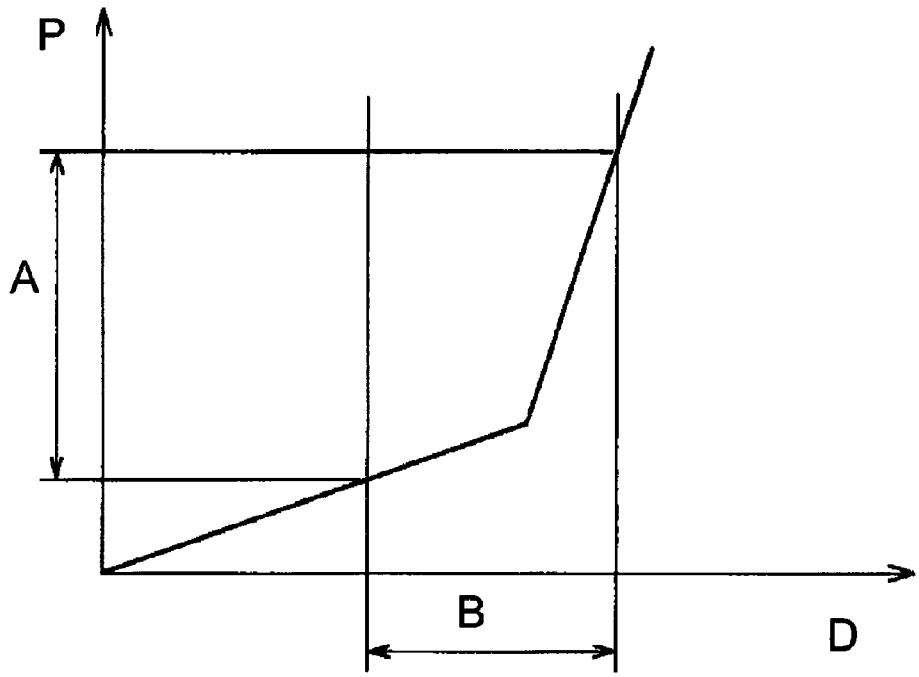
FIGS. 7A to 7B illustrate relation between deformation amount of the connector and contact pressure of the connector.
Figure 7B:
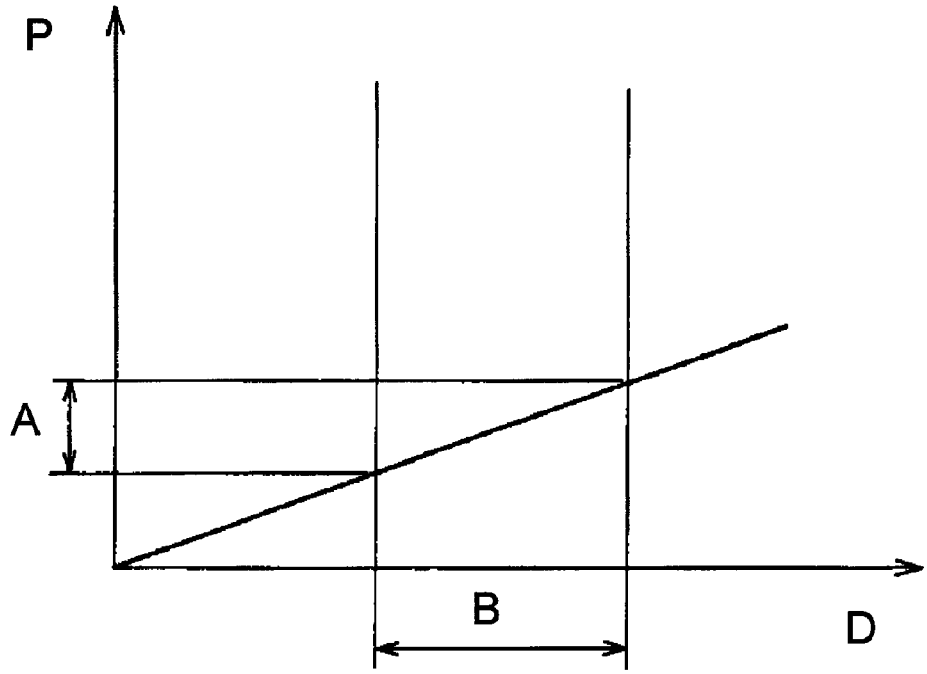

Next, FIGS. 7A and 7B illustrate relation between deformation amount of the connector and contact pressure of the connector. In FIGS. 7A and 7B, P in y-axis indicates the contact pressure of the connector, A in y-axis indicates a range of the contact pressure, D in x-axis indicates deformation amount of the connector and B indicates a range of the deformation amount. FIG. 7B illustrates linear change of spring load that a moving member receives from an elastic member. The range of the contact pressure illustrated in FIG. 7B in the connector of the embodiments is smaller than the range of the contact pressure illustrated in FIG. 7A in a conventional connector corresponding to the same range of the deformation amount. That is, the variation of the contact pressure in the connector of the embodiments is small. Therefore, in the interposer including the connector according to the embodiments, the interposer has the advantage of stability and high reliability even if the interposer connects a plurality of pins. Therefore the interposer using the connector of the embodiments improves high reliability and signal quality of a component that large and a high-speed IC package is stacked and mounted on the circuit board via the interposer. As a result, a higher-speed apparatus with higher density mounting may be developed.

Figure 8A:
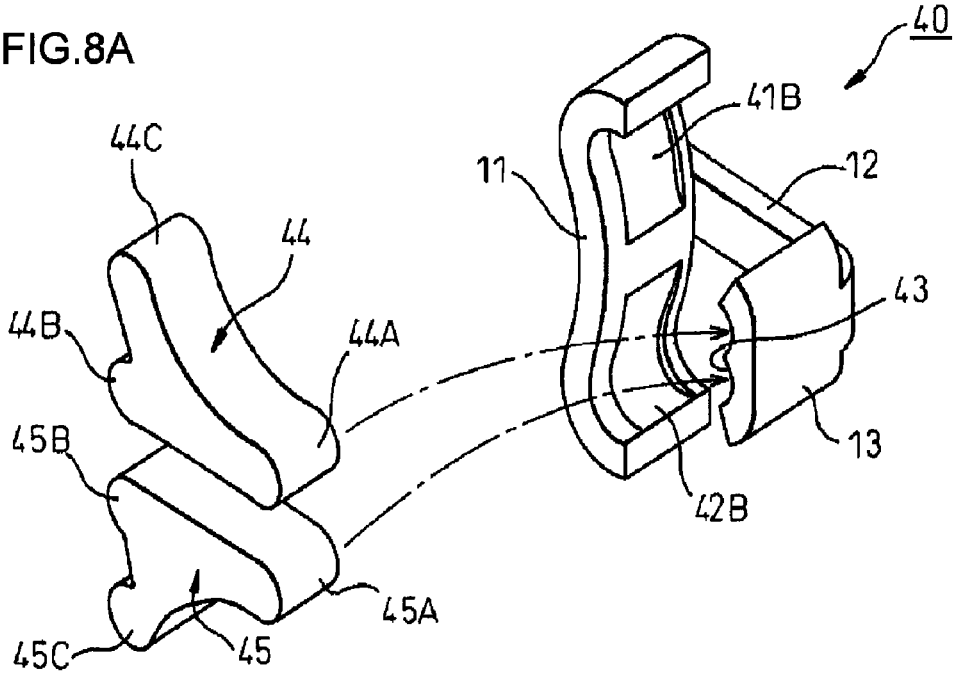
FIGS. 8A to 8D illustrates a connector according to a fourth embodiment.

FIGS. 8A to 8D illustrates a connector according to a fourth embodiment. The points that a connector 40 of the firth embodiment is different from the connector 30 of the third embodiment are shape of the base unit 11, shape of the spring body 12, shape of the holding unit 13, shape of the first contact 44, and shape of the second contact 45 as illustrated in FIG. 8A. In the connector 40 of the fourth embodiment, first of all, seen from the sides of the base unit 11, the shape of the base unit 11 is W-character shape that height is small and width is horizontally long. And, two recesses 41B and 42B are formed on each inner surface of two concave parts in the base unit 11 so as to prevent the first contact 44 and the second contact 45 described later from releasing from the base unit 11. The recesses 41B and 42B may be formed as one recess portion when boundary between the recesses 41B and 42B are took down. Moreover, concave parts 43 forming W-shape in the holding unit 13 are formed on the opposite surface to the base unit 11. A recess further may be formed in the concave parts 43.

Figure 8C:
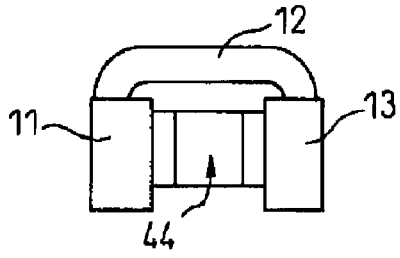

As illustrated in FIG. 8C, the side face of the base unit 11 and the side face of the holding unit 13 are connected with the spring body 12. On the other hand, seen from the sides of the first contact 44 and the second contact 45, the shape of the first contact 44 and the shape of the second contact 45 in the fourth embodiment each is formed in r-character shape. Each of the contact 44 and the contact 45 has three ends. The ends 44A and 45A correspond to the action parts of the contacts 14 and 15, respectively. The ends 44B and 45B correspond to the sliding parts of the contacts 14 and 15, respectively. The ends 44C and 45C correspond to the contact parts of the contacts 14 and 15, respectively.

Figure 8B:
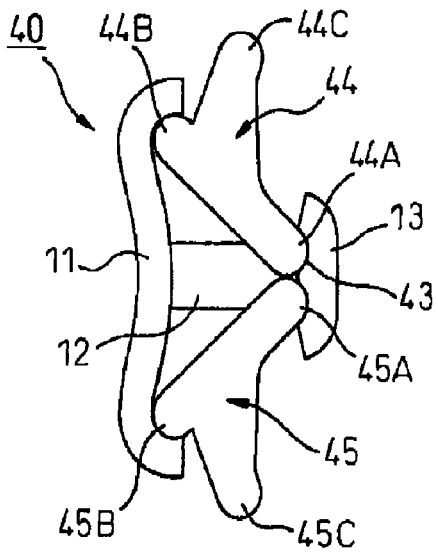

The contacts 44 and 45 in the fourth embodiment are fitted between the base unit 11 and the holding unit 13. The ends 44A and 45A (action parts) are fitted in the concave parts 43 in the holding unit 13. The ends 44B and 45B (sliding parts) are fitted in recesses 41B and 42B. As illustrated in FIG. 8B, the ends 44C and 45C (contact parts) protrudes outside from the base unit 11. The holding unit 13 and contacts 44 and 45 are made of conductive material as well as above-mentioned embodiments.

Figure 8D:
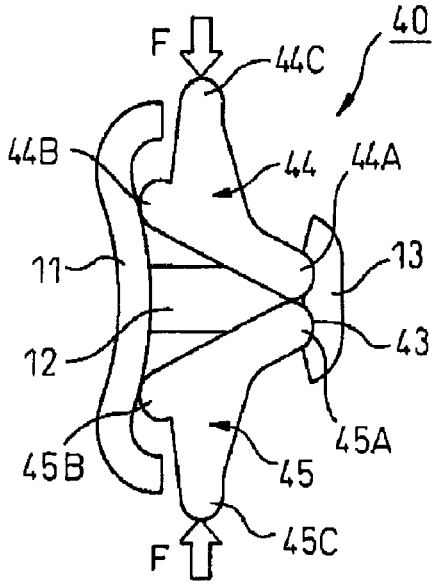

In the connector 40 of the fourth embodiment as illustrated in FIG. 8D, when the ends 44C and 45 C (contact parts) are pushed by the force "F" in vertical direction, the ends 44B (sliding part) of the contact 44 and the ends 45B (sliding part) of the contact 45 respectively move in the center of the base unit 11. When the ends 44A and 45A (action parts) push the holding unit 13 by the movement of the ends 44B and 45B (sliding parts), the spring body 12 curves and thereby the holding unit 13 moves. In the fourth embodiment, the ends 44B and 45B (sliding parts) are fitted in the recesses 41B and 42B of the base unit 11, and the ends 44A and 45A (action parts) are fitted in the concave parts 43 of the holding unit 13. Therefore the contacts 44 and 45 do not easily release from the base unit 11 and the holding unit 13.

According to the embodiments, the interposer includes a metal component which is used as an electrical path and a metal which is elastically deformed. And as the metal which is used as the electrical path is formed in small size, the interposer has a short electrical path. Thereby the IC package and the circuit board are connected at a short distance, and the structure is simple. As a result the interposer is manufactured at low cost. In addition, this interposer improves high reliability and signal quality of a component that large and a high-speed IC package is stacked and mounted on the circuit board via the interposer.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a illustrating of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. A connector disposed in each of through-holes formed in a substrate, the connector being configured to electrically conduct between opposed external electrodes disposed on a top and bottom of the substrate, the connector comprising:

a pair of rigid conductive contacts each having a portion serving as a point of force, a portion serving as a fulcrum, and a portion serving as a point of action; and an elastic body including a base unit that is contacted by the portion serving as the fulcrum of each of the pair of rigid conductive contacts, a holding unit that is disposed opposite the base unit and holds the portion serving as the point of action of each of the pair of rigid conductive contacts, and an elastic unit configured to connect the base unit to the holding unit and to elastically deform to receive load caused by movement of each of pair of rigid conductive contacts upon the portion serving as the point of force of each of the pair of rigid conductive contacts being pressed.

2. The connector according to claim 1, wherein each of the pair of rigid conductive contacts is formed in a nearly L-shape.

3. The connector according to claim 1, wherein when each of the external electrodes presses the corresponding portion serving as the point of force of each of the pair of rigid conductive contacts, the portion serving as the fulcrum of each of the pair of rigid conductive contacts slides on the base unit, and the portion serving as the point of action of each of the pair of rigid conductive contacts deforms the elastic unit to move the holding unit.

4. The connector according to claim 1, wherein the elastic body has a U-shape in a plan view.

5. The connector according to claim 1, wherein a recess, which holds the portion serving as the point of action of each of the pair of rigid conductive contacts, is formed in the holding unit.

6. The connector according to claim 5, wherein the recess of the holding unit is formed in a hemisphere shape and the portion serving as the point of the action of each of the pair of rigid conductive contacts is formed in a spherical surface.

7. The connector according to claim 1, wherein a recess that holds the portion serving as the fulcrum of each of the pair of rigid conductive contacts is formed in the base unit.

8. The connector according to claim 1, wherein the elastic unit comprises a plate spring.

9. The connector according to claim 1, wherein the holding unit comprises a conductive member.

10. An interposer comprising:

a planar substrate comprising a dielectric material and having a plurality of through-holes; and a connector configured to be inserted into each of the through-holes of the planar substrate, and configured to electrically conduct between opposed external electrodes disposed on a top and bottom of the planar substrate, the connector including a pair of rigid conductive contacts, each having a portion serving as a point of force, a portion serving as a fulcrum, and a portion serving as a point of action; and an elastic body including a base unit that is contacted by the portion serving as the fulcrum of each of the pair of rigid conductive contacts, a holding unit that is disposed opposite the base unit and holds the portion serving as the point of action of each of the pair of rigid conductive contacts, and an elastic unit configured to connect the base unit to the holding unit and to elastically deform to receive load caused by movement of each of the pair of rigid conductive contacts upon the portion serving as the point of force of each of the pair of rigid conductive contacts being pressed.

11. The interposer according to claim 10, wherein each of the pair of rigid conductive contacts of the connector is formed in a nearly L-shape, and wherein the portion serving as the point of force of each of the pair of rigid conductive contacts of the connector protrudes from the planar substrate.

12. The interposer according to claim 10, wherein when each of the external electrodes presses the corresponding portion serving as the point of force of each of the pair of rigid conductive contacts, the portion serving as the fulcrum of each of the pair of rigid conductive contacts slides on the base unit and the portion serving as the point of action of each of the pair of rigid conductive contacts deforms the elastic unit to move the holding unit.

13. The interposer according to claim 10, wherein the elastic body has a U-shape in a plan view.

14. The interposer according to claim 10, wherein a recess that holds the portion serving as the point of action of each of the pair of rigid conductive contacts is formed in the holding unit.

15. The interposer according to claim 14, wherein the recess of the holding unit is formed in a hemisphere shape and the portion serving as the point of the action of each of the pair of rigid conductive contacts is formed into a spherical surface.

16. The interposer according to claim 10, wherein a recess that holds the portion serving as the fulcrum of each of the pair of rigid conductive contacts is formed in the base unit.

17. The interposer according to claim 10, wherein each of the through-holes has a groove in which the base unit is inserted for positioning the connector in each of the through-hole.

18. The interposer according to claim 10, wherein the holding unit comprises a conductive member.

19. The interposer according to claim 10, wherein a socket made of dielectric member is arranged in surrounding the planar substrate, and wherein the socket includes a recess on the top side thereof for mounting an IC package with electrodes on the back side of the IC package and a fixing unit on the back side thereof for fixing a circuit board with electrodes on the top side of the circuit board.

* * * * *